US012734570B2

(12) United States Patent
Gao

(10) Patent No.: US 12,734,570 B2
(45) Date of Patent: Sep. 15, 2026

(54) THREE-DIMENSIONAL QUICK REPLACEMENT MACHINE FOR PRODUCTION LINE

(71) Applicant: DALIAN FIELD MANUFACTURING CO., LTD, Dalian (CN)

(72) Inventor: Guowu Gao, Dalian (CN)

(73) Assignee: DALIAN FIELD MANUFACTURING CO., LTD, Dalian (CN)

( * ) Notice: Subject to any disclaimer, the term of this patent is extended or adjusted under 35 U.S.C. 154(b) by 424 days.

(21) Appl. No.: 18/281,783

(22) PCT Filed: May 8, 2022

(86) PCT No.: PCT/CN2022/091578

§ 371 (c)(1),
(2) Date: Sep. 13, 2023

(87) PCT Pub. No.: WO2022/257672

PCT Pub. Date: Dec. 15, 2022

(65) Prior Publication Data

US 2024/0157419 A1 May 16, 2024

(30) Foreign Application Priority Data

Jun. 9, 2021 (CN) ..... 202110640796.7

(51) Int. Cl.
*B21B 31/12* (2006.01)

(52) U.S. Cl.
CPC ..... *B21B 31/12* (2013.01)

(58) Field of Classification Search
CPC ..... B21B 31/08; B21B 31/10; B21B 31/103; B21B 31/106; B21B 31/12
See application file for complete search history.

(56) References Cited

U.S. PATENT DOCUMENTS 4,706,484 A 11/1987 Dittmar et al.
5,281,077 A * 1/1994 Phillips ..... B63C 3/06 187/242

(Continued)

FOREIGN PATENT DOCUMENTS

CN 200988691 Y 12/2007
CN 108114988 A 6/2018

(Continued)

OTHER PUBLICATIONS

Machine translation of CN-110340735-A (Year: 2019).*

(Continued)

*Primary Examiner* — Kyle A Cook
(74) *Attorney, Agent, or Firm* — East IP P.C.

(57) ABSTRACT

When changing product specifications in the existing longitudinal seam steel pipe production lines, manual operations on line are generally used to replace an entire set of rollers that need to be replaced while the production lines are shut down, or robots are used to replace rollers in a fully automatic manner, but the equipment for roller replacement by robot takes up a lot of space and is expensive. The present implementations provide a three-dimensional quick replacement machine for a production line, which completes the entire operation of specification change by providing a first unit, a second unit, a three-dimensional frame, a forming base, and a switching device, the switching device drives the first or second unit to move up and down in the three-dimensional frame, and the first and second units are alternately installed on the forming base to achieve the change of specification in the production line.

6 Claims, 13 Drawing Sheets

(56) References Cited

U.S. PATENT DOCUMENTS

| | | | | |
|---|---|---|---|---|
| 5,971,108 | A * | 10/1999 | Yu | B65G 57/03 187/270 |
| 6,186,280 | B1 * | 2/2001 | Healy | B66F 7/20 187/390 |
| 2003/0118427 | A1 * | 6/2003 | Kojo | D21G 1/0293 414/282 |
| 2015/0290688 | A1 * | 10/2015 | Potthoff | B21B 31/08 72/237 |
| 2020/0238505 | A1 * | 7/2020 | Parks, II | B25J 9/0027 |
| 2020/0391986 | A1 * | 12/2020 | Picha | B66F 7/28 |

FOREIGN PATENT DOCUMENTS

| | | | |
|---|---|---|---|
| CN | 110340735 | A | 10/2019 |
| CN | 110606341 | A | 12/2019 |
| CN | 113198847 | A | 8/2021 |
| CN | 214919224 | U | 11/2021 |
| JP | S56160812 | A | 12/1981 |

OTHER PUBLICATIONS

Machine translation of CN-110606341-A (Year: 2019).*
Machine translation of CN200988691Y (Year: 2007).*
The First Office Action for Chinese Application No. 202110640796.7, dated Dec. 21, 2024, 7 pages.
The International search report for PCT Application No. PCT/CN2022/091578, dated Jul. 27, 2022, 5 pages.

* cited by examiner

THREE-DIMENSIONAL QUICK REPLACEMENT MACHINE FOR PRODUCTION LINE

CROSS REFERENCES TO RELATED APPLICATIONS

The present application is a national phase of PCT Application No. PCT/CN2022/091578, filed on May 8, 2022 and claiming a priority of Chinese Application No. 202110640796.7 filed on Jun. 9, 2021, both of which are incorporated here in their entireties.

TECHNICAL FIELD

The present application relates to a field of modular quick replacement technology for changing specifications in automated production lines, and specifically relates to a three-dimensional quick replacement machine for a production line.

BACKGROUND

In the production line of longitudinal seam steel pipes, due to diversity of products, manufacturers often need to change product specifications of their production lines, and the production lines also are required to have ability to process products of multiple specifications. So, solutions for the production lines to handle quick replacement of the product specifications and efficiency of the replacement are involved. When changing the product specifications in the existing longitudinal seam steel pipe production lines, manual operations on line are generally used to replace an entire set of rollers that need to be replaced while the production lines are shut down, and this manner is inefficient and has low safety. However, although the entire operation for changing specifications can be completed effectively and safely by robot in a manner of fully automatic roller replacement, the equipment for roller replacement by robot takes up a lot of space and is expensive, it is only suitable for frequent replacements of multiple specifications on one production line, while is not very suitable when only two specifications need to be replaced on one production line. Therefore, the person skilled in the field needs to develop a three-dimensional quick replacement machine for a production line that can efficiently, safely, and cheaply solve the problem of quick replacement of two specifications, and this has become a trend.

SUMMARY

Technical Problems

This implementations provide a three-dimensional quick replacement machine for a production line that can efficiently, safely, and cheaply solve the problem of quick replacement of two specifications. The machine is provided with a first unit, a second unit, a three-dimensional frame, a forming base, and a switching device to complete the entire operation of specification change, the switching device drives the first or second unit to move up and down in the three-dimensional frame, and the first and second units are alternately installed on the forming base to achieve the change of specification in the production line.

Technical Solutions

Specifically, on one aspect, a three-dimensional quick replacement machine for a production line is provided for quickly changing specifications of forming units in the production line, which includes a first unit 1 and a second unit 2, the first unit 1 and the second unit 2 have different processing specifications and both need to be installed on a forming base d to participate in production operations of the production line, characterized in that, the three-dimensional quick replacement machine is further provided with a three-dimensional frame k, a first compartment c1, a second compartment c2 and a third compartment c3 are provided on the three-dimensional frame k, and the forming base d is disposed in the first compartment c1; a switching device p is further disposed next to the three-dimensional frame k, and the switching device p can drive the first unit 1 and the second unit 2 to alternately appear in the first compartment c1, the second compartment c2 and the third compartment c3, so as to alternately install the first unit 1 and the second unit 2 on the forming base d to achieve change of the specification in the production line.

According to one aspect of the embodiments of the present disclosure, each of the second compartment c2 and the third compartment c3 is provided with a push-pull manipulator y, and the push-pull manipulator y is provided with a push-pull hook yg at an end; each of the first unit 1 and the second unit 2 is further provided with a load-bearing hook g for matching with the push-pull hook yg at an end, and by means of matching of the push-pull hook yg with the load-bearing hook g, the first unit 1 and the second unit 2 can be pulled into or pushed out of the second compartment c2 and the third compartment c3 by the push-pull manipulator y.

According to one aspect of the embodiments of the present disclosure, the switching device p is formed as a hoisting mechanism, which is provided with two sets of hoisting machines q, the two sets of hoisting machines q are respectively disposed on two sides of an upper end of the three-dimensional frame k, and each set of hoisting machines q is provided with a hoisting hook s; each of the first unit 1 and the second unit 2 is provided with a hoisting hole sk for matching with the hoisting hook s, and the two sets of hoisting machines q can hoist the first unit 1 or the second unit 2 to move up and down in the three-dimensional frame k.

According to one aspect of a second embodiment of the present disclosure, the switching device p is formed as a lifting hydraulic cylinder structure, two sets of lifting hydraulic cylinders w are disposed on two sides of the three-dimensional frame k, and an end of each of the lifting hydraulic cylinders w is installed with a sliding block h; the sliding block h is coupled with the three-dimensional frame k through a linear sliding rail hg, the sliding block h can support the first unit 1 or the second unit 2, and under the action of the lifting hydraulic cylinder w, the sliding block h can drive the first unit 1 or the second unit 2 to move up and down in the three-dimensional frame k.

According to one aspect of a third embodiment of the present disclosure, the switching device p is formed as a chain structure, wherein a set of annular closed chain u is disposed on each of two sides of the three-dimensional frame k, a driver f is disposed at a bottom of the chain u, and a sliding block h is further disposed on the chain u; the sliding block h is coupled with the three-dimensional frame k through a linear sliding rail hg and can support the first unit 1 or the second unit 2, and the driver f can drive the chain u to rotate and drive the sliding block h to support the first unit 1 or the second unit 2 to move up and down in the three-dimensional frame k.

According to one aspect of a fourth embodiment of the present disclosure, the switching device p is formed as a scissor lift structure, and a scissor lift r is disposed on one side of the three-dimensional frame k, the scissor lift r is provided with a platform e, and the platform e can support the first unit 1 or the second unit 2; under the action of the scissor lift r, the platform e can drive the first unit 1 or the second unit 2 to move up and down in the three-dimensional frame k.

According to one aspect of the present disclosure, the forming base d is provided with positioning pins dx, and both of the first unit 1 and the second unit 2 are provided with positioning holes dk; positions of the first unit 1 and the second unit 2 relative to the forming base d can be accurately positioned through matching of the positioning pins dx with the positioning holes dk, thereby ensuring processing accuracy of the production line.

BRIEF DESCRIPTION OF THE DRAWINGS

The features, advantages and technical effects of exemplary embodiments of the present application will be described below with reference to the accompanying drawings.

Description of reference numerals: first unit 1, second unit 2, forming base d, three-dimensional frame k, first compartment c1, second compartment c2, third compartment c3, switching device p, push-pull manipulator y, push-pull hook yg, load-bearing hook g, hoisting machine q, hoisting hook s, hoisting hole sk, lifting hydraulic cylinder w, sliding block h, linear sliding rail hg, chain u, driver f, scissor lift r, platform e, positioning pin dx, positioning hole dk, feeding tray ss, continuous material wc.

In the accompanying drawings, the same reference numerals are used for the same components. The accompanying drawings are not drawn to the actual scale.

DETAILED EMBODIMENTS OF THE PRESENT DISCLOSURE

The implementations of the present disclosure are further described in detail below in combination with the accompanying drawings and embodiments. The detailed description of the following embodiments and accompanying drawings are used to exemplarily illustrate the principle of the present disclosure, while not intended to limit the scope of the present disclosure, that is, the present disclosure is not limited to the described preferred embodiments, and the scope of the present disclosure is defined by the claims.

In the description of embodiments of the present disclosure, it should be noted that, unless otherwise stated, the terms "perpendicular" and "parallel" not only refer to "perpendicular" and "parallel" absolutely in mathematical sense, but also can be understood as "roughly perpendicular" and "roughly parallel".

Figure 1:
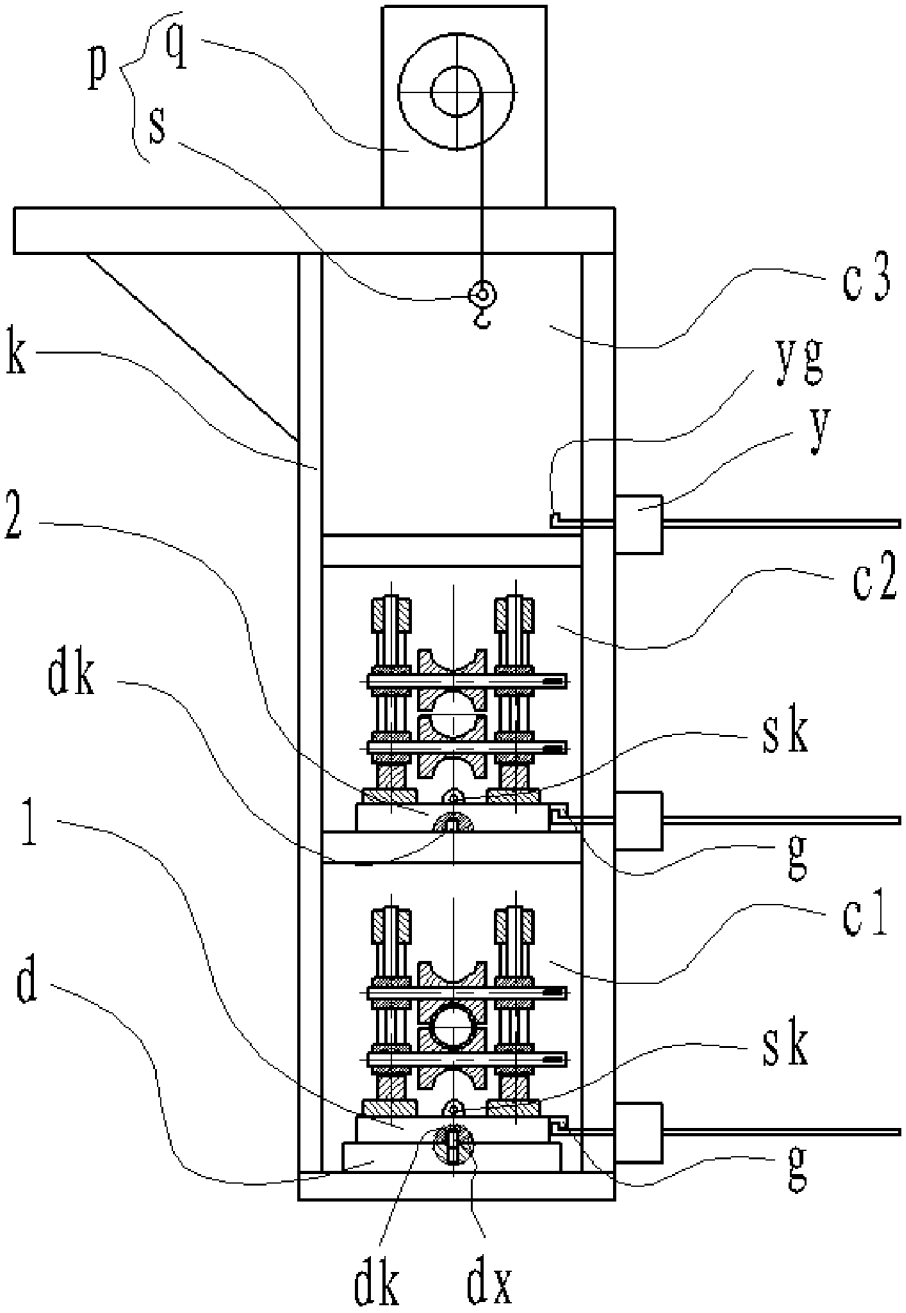
FIG. 1 is a schematic diagram of a layout of a basic structure in a first embodiment of the present disclosure.

FIG. 1 is a schematic diagram of a layout of a basic structure in a first embodiment of the present disclosure.

Figure 7:
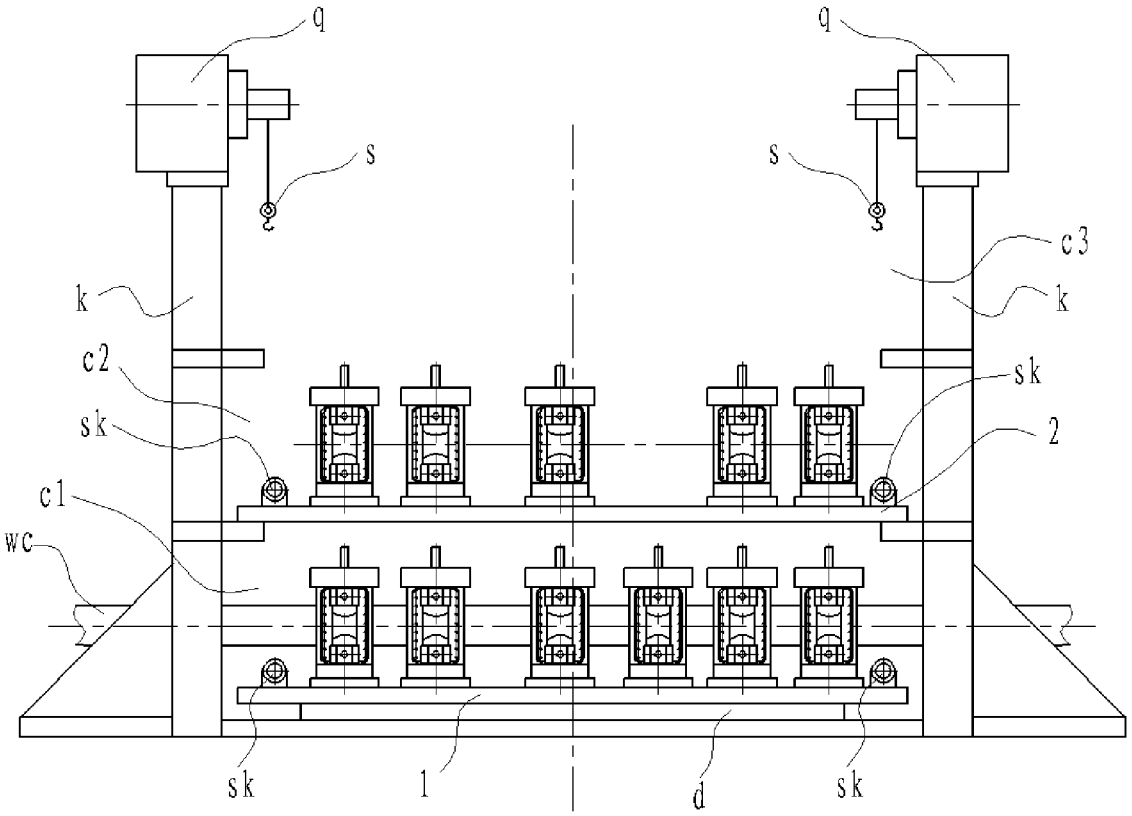
FIG. 7 is a schematic diagram of a front view of the first embodiment of the present disclosure.

FIG. 7 is a schematic diagram of a front view of the first embodiment of the present disclosure.

As shown in FIGS. 1 and 7, the present implementation provides a three-dimensional quick replacement machine for a production line that can achieve quick replacement of two specifications efficiently, safely, and cheaply. The entire operation for specification change is completed by providing a first unit, a second unit, a three-dimensional frame, a forming base, and a switching device, wherein the first unit and second unit are driven by the switching device to move up and down in the three-dimensional frame, and are alternately installed on the forming base of the production line, so as to achieve change of the specification in the production line. In the specific implementation of the present embodiment, the three-dimensional quick replacement machine includes a first unit 1, a second unit 2, a forming base d, a three-dimensional frame k, and a switching device p, each of the first unit 1 and the second unit 2 is an independent module that can be replaced as a whole, and each of the first unit 1 and the second unit 2 is provided with a rolling unit for continuous rolling processing of a continuous material wc in the production line; the first unit 1 and the second unit 2 have different processing specifications, and both the first unit 1 and the second unit 2 can be independently installed on the forming base d; and both the first unit 1 and the second unit 2 need to be installed on the forming base d to participate in the production operations of the production line. The forming base d is formed as a welded box structure, and an upper part of the forming base d is provided with a planar surface on which the first unit 1 or the second unit 2 can be placed; the forming base d is disposed in a working position of the production line, and once the first unit 1 or the second unit 2 is installed on the forming base d, the first unit 1 or the second unit 2 can accurately participate in the production operations of the production line. Further, a positioning pin dx is further provided on the forming base d, and the positioning pin dx can extend or retract relative to an upper surface of the forming base d according to specific circumstances; each of the first unit 1 and the second unit 2 is further provided with a welded box structure at a bottom, which is adapted to bear and support the roller unit above it, the welded box structure is further provided with a positioning hole dk at a bottom, and the positioning hole dk can match with the positioning pin dx to accurately position the first unit 1 or the second unit 2 on the forming base d, so as to ensure processing accuracy of the first unit 1 or the second unit 2 in the production line.

Figure 2:
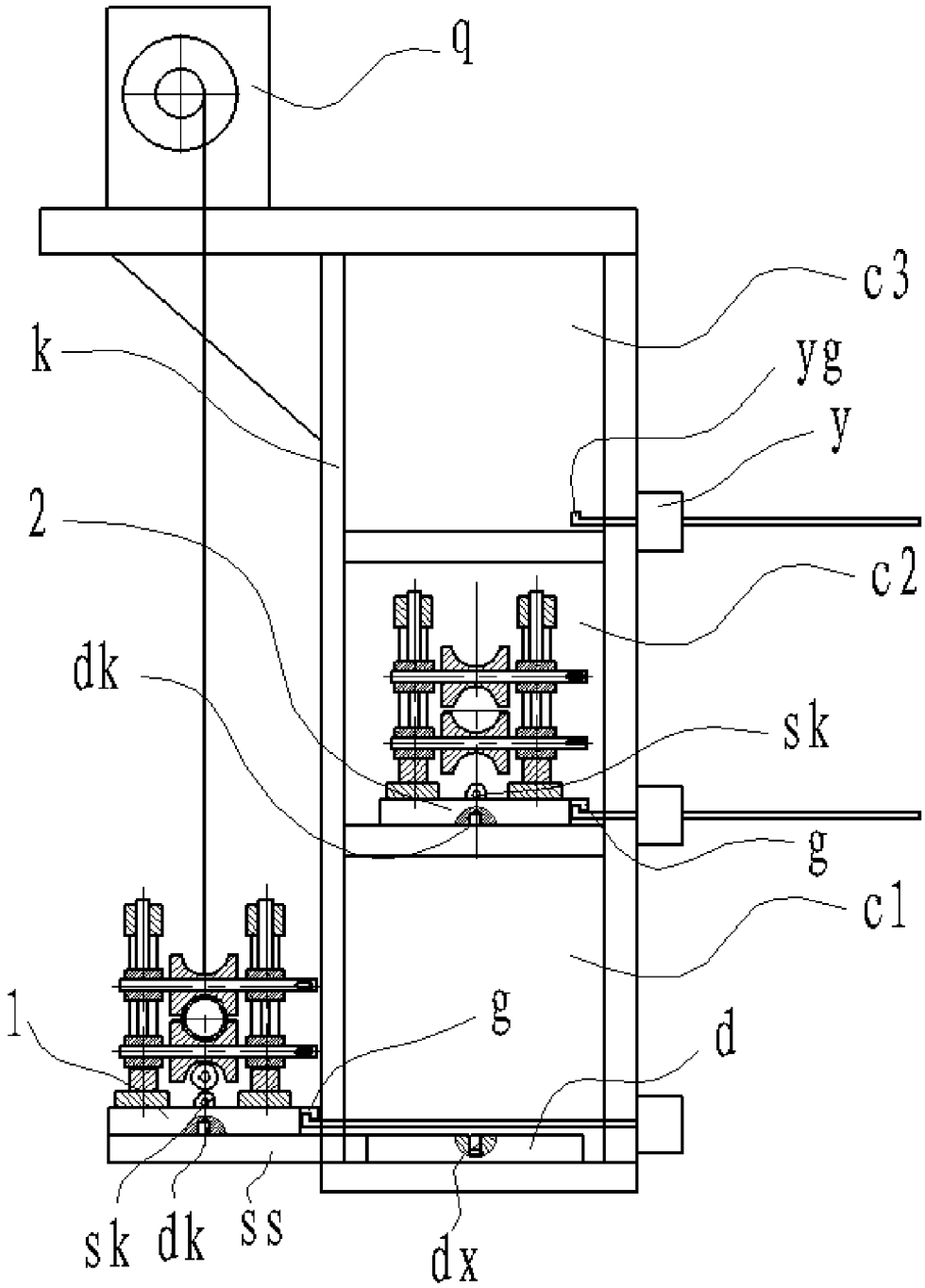
FIG. 2 is a schematic diagram of a first unit 1 being pushed out in the first embodiment of the present disclosure.

FIG. 2 is a schematic diagram of the first unit 1 being pushed out in the first embodiment of the present disclosure.

Figure 3:
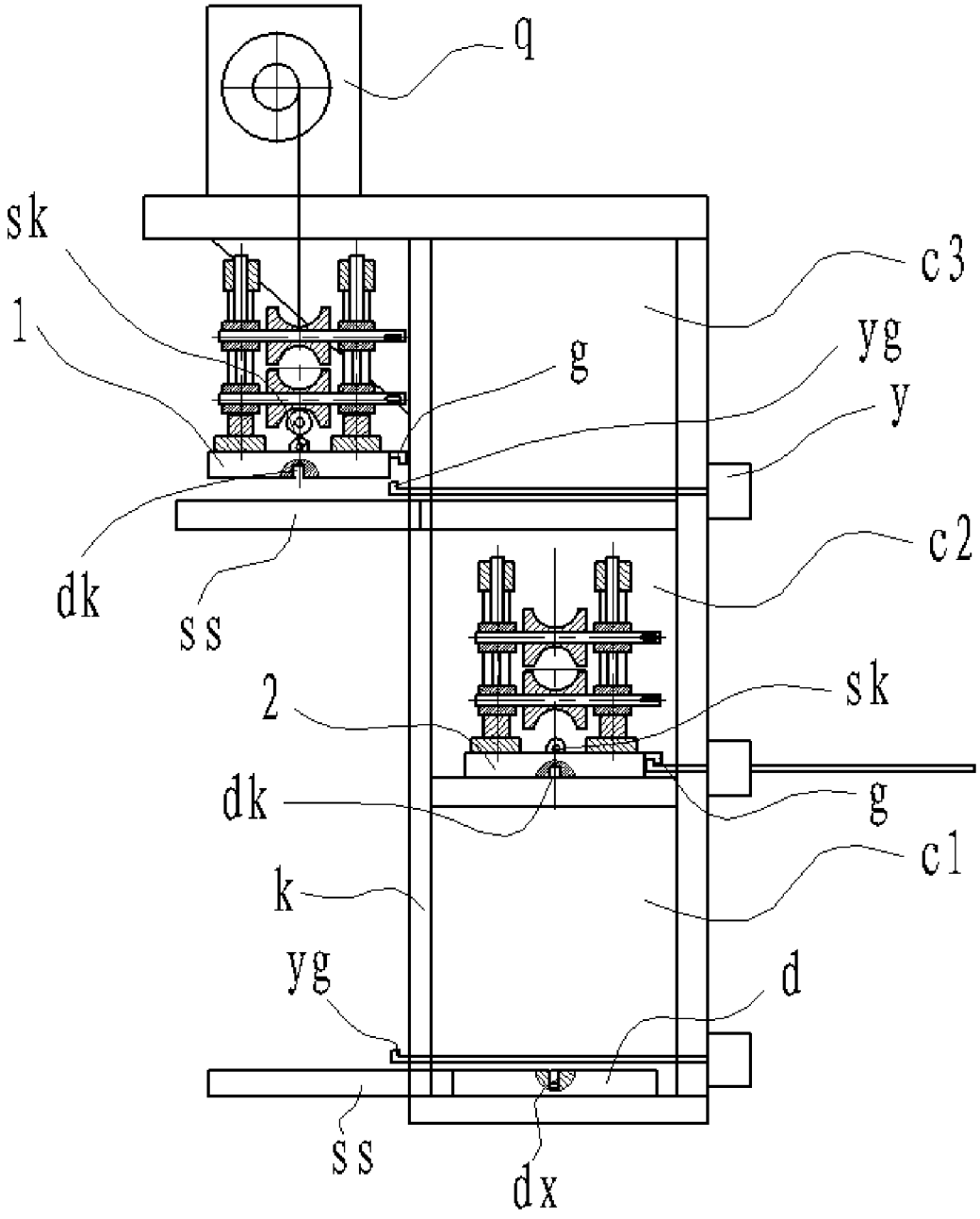
FIG. 3 is a schematic diagram of the first unit 1 entering a third compartment c3 in the first embodiment of the present disclosure.

FIG. 3 is a schematic diagram of the first unit 1 entering a third compartment c3 in the first embodiment of the present disclosure.

Figure 4:
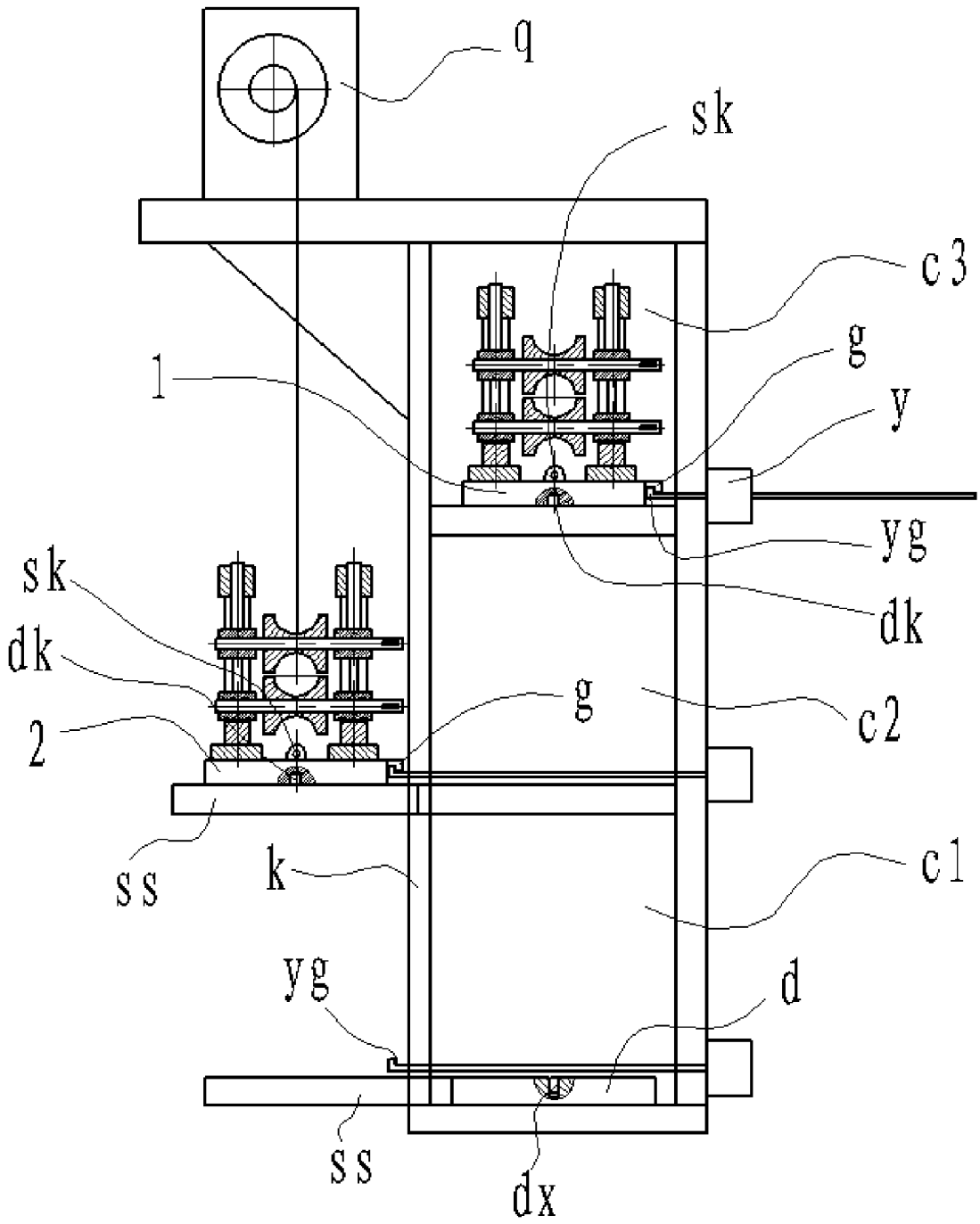
FIG. 4 is a schematic diagram of a second unit 2 going out of compartments in the first embodiment of the present disclosure.

FIG. 4 is a schematic diagram of the second unit 2 going out of compartments in the first embodiment of the present disclosure.

As shown in FIGS. 2, 3, and 4, according to one aspect of the first embodiment of the present disclosure, a first compartment c1, a second compartment c2, and a third compartment c3 are provided in the three-dimensional frame k. In the present embodiment, the three-dimensional frame k is formed as a space welded frame structure, and an up-down space within the frame is divided into three space compartments by steel beam structures, where the first compartment c1 is the space compartment located in the lowest layer, the second compartment c2 is the space compartment located in the middle layer, and the third compartment c3 is the space compartment located in the upper most layer. In each space compartment, a feeding tray ss is provided, the feeding tray ss is coupled with the space compartment in each layer through a sliding rail, and the feeding tray ss can extend or retract relative to the space compartment in each layer, and is adapted to transport the first unit 1 or the second unit 2 out of or into the corresponding space compartment. In the present embodiment, a push-pull manipulator y is provided in each of the first compartment c1, the second compartment c2 and the third compartment c3, the push-pull manipulator y is located at an end of each of the first compartment c1, the second compartment c2 and the third compartment c3, and the push-pull manipulator y is further provided with a push-pull hook yg, which is provided on a push-pull rod at an end of the push-pull manipulator y; by operating the push-pull rod to extend or retract through the push-pull manipulator y, the push-pull hook yg can enter or exist relative to the first compartment c1, the second compartment c2 and the third compartment c3. Correspondingly, each of the first unit 1 and the second unit 2 is further provided with a load-bearing hook g at an end, and the load-bearing hook g can match with the push-pull hook yg to fasten with or separate from each other. By operating the push-pull rod to extend or retract through the push-pull manipulator y, the first unit 1 or the second unit 2 is finally pulled in or pushed out of the first compartment c1, the second compartment c2, and the third compartment c3.

Figure 5:
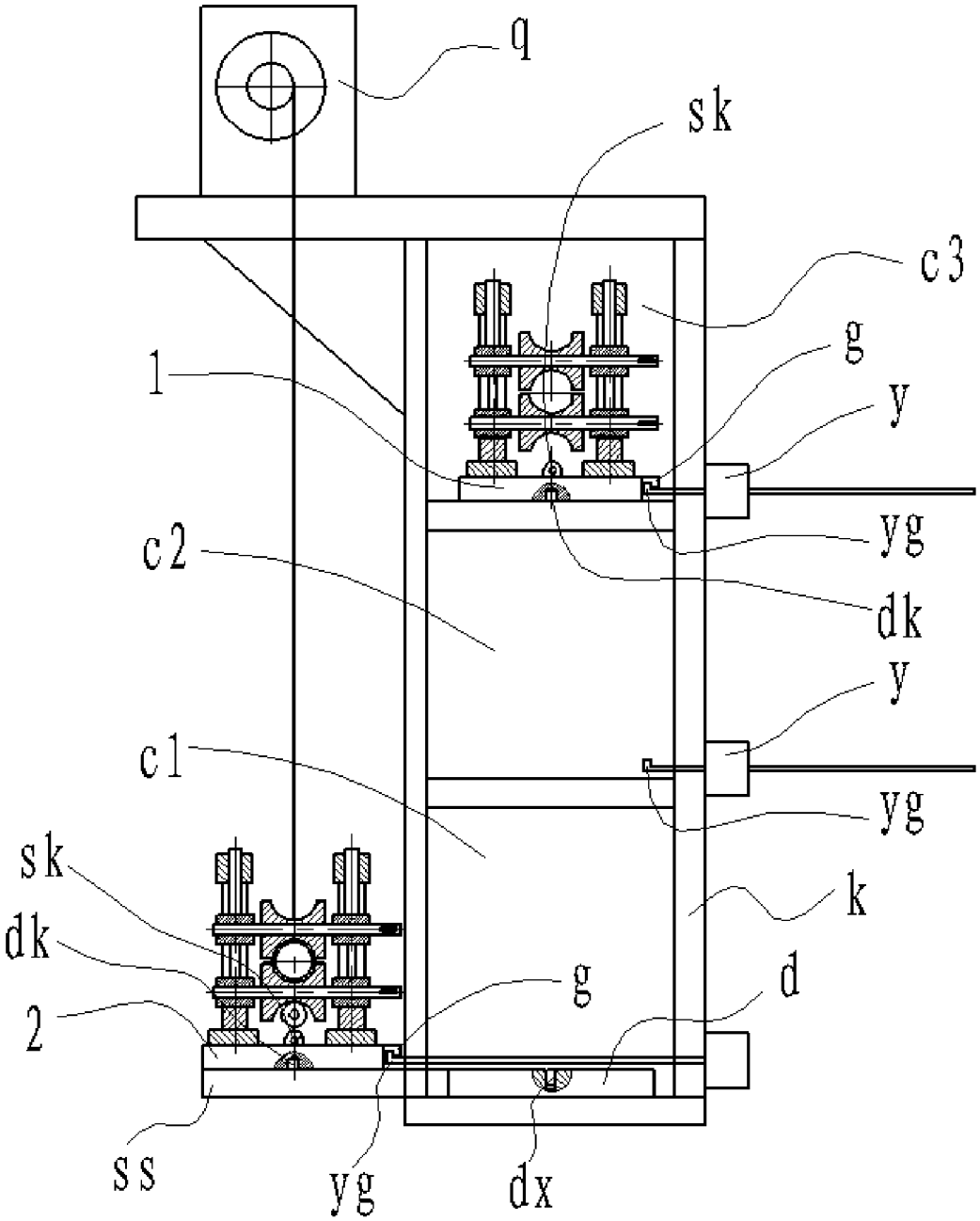
FIG. 5 is a schematic diagram of the second unit 2 entering a first compartment c1 in the first embodiment of the present disclosure.

FIG. 5 is a schematic diagram of the second unit 2 entering the first compartment c1 in the first embodiment of the present disclosure.

Figure 6:
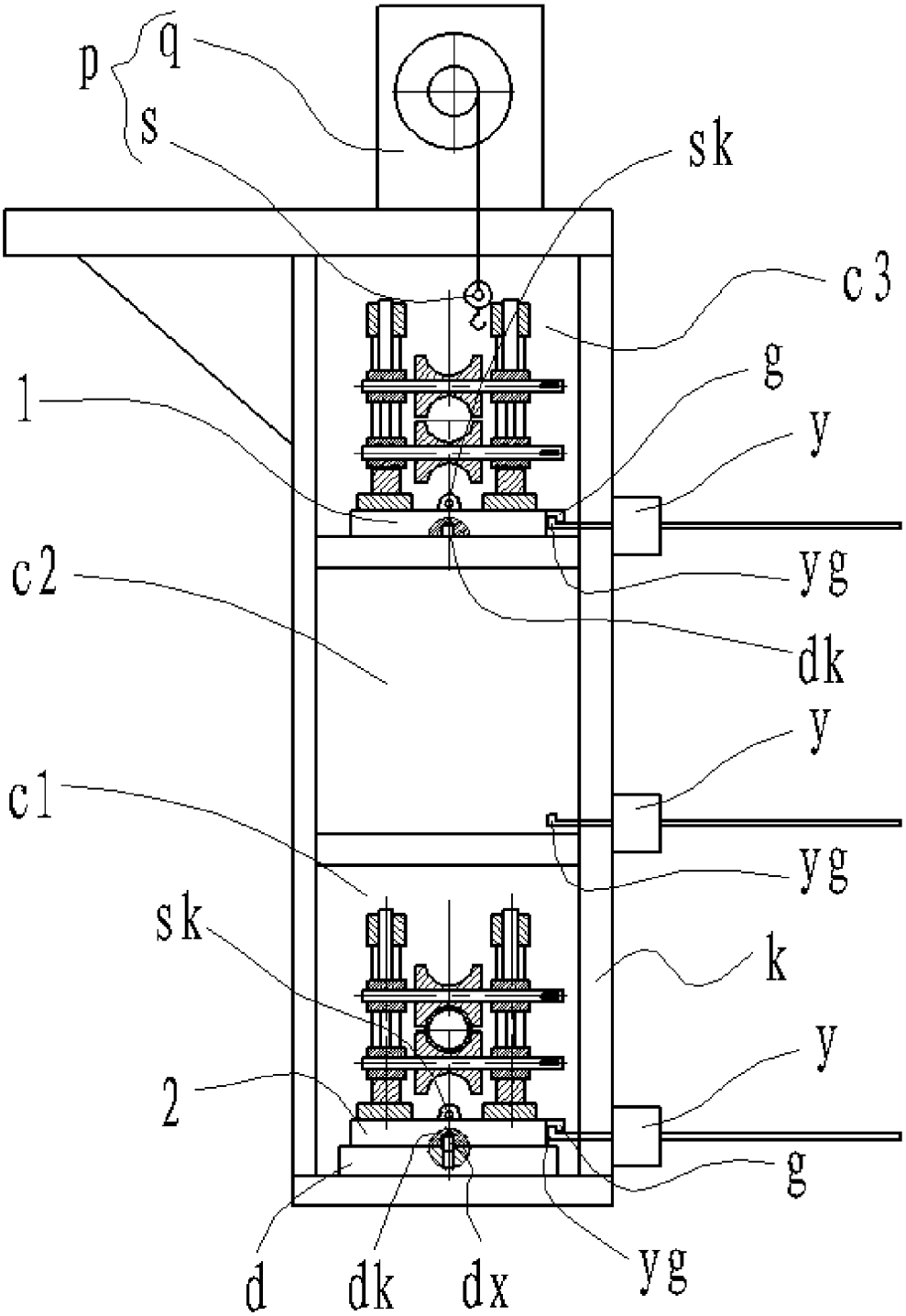
FIG. 6 is a schematic diagram of a hoisting machine q returning back in place in the first embodiment of the present disclosure.

FIG. 6 is a schematic diagram of a hoisting machine q returning back in place in the first embodiment of the present disclosure.

FIG. 7 is a schematic diagram of a front view of the first embodiment of the present disclosure.

As shown in FIGS. 5, 6 and 7, according to one aspect of the first embodiment of the present disclosure, the switching device p is disposed on an upper end of the three-dimensional frame k, the switching device p is formed as a hoisting mechanism, which is provided with two sets of hoisting machines q, and the two sets of hoisting machines q are respectively disposed on two sides of the upper end of the three-dimensional frame k; each set of the hoisting machines q is provided with a hoisting hook s, each of the first unit 1 and the second unit 2 is provided with a hoisting hole sk that matches with the hoisting hook s, and the two sets of hoisting machines q can hoist the first unit 1 or the second unit 2 to move up and down in the three-dimensional frame k. The switching device p can drive the first unit 1 and the second unit 2 to alternately appear in the first compartment c1, the second compartment c2, and the third compartment c3, so that the first unit 1 and the second unit 2 are alternately installed on the forming base d to achieve change of the specification in the production line. In the present embodiment, the hoisting machine q is coupled with the three-dimensional frame k through a sliding rail and can slide left and right at the upper end of the three-dimensional frame k; in this way, the hoisting machine q can more conveniently coordinate with the feeding tray ss and the push-pull manipulator y in each space compartment to operate and thus to complete the replacement between the first unit 1 and the second unit 2.

According to one aspect of the first embodiment of the present disclosure, the specific operating process is as follows: at first, the hoisting machine q moves to a left side on the three-dimensional frame k, and at the same time, the push-pull manipulator y in the first compartment c1 pushes the first unit 1 on the feeding tray ss in the first compartment c1 to move out of the first compartment c1; then, the hoisting machine q lowers the hoisting hook s which is hooked into the hoisting hole sk of the first unit 1, and hoists the first unit 1 to an outer side of the third compartment c3, the feeding tray ss in the third compartment c3 receives the first unit 1, and the push-pull manipulator y in the third compartment c3 pulls the first unit 1 into the third compartment c3 and the first unit 1 is fixed. After that, the hoisting hook s is detached from the hoisting hole sk of the first unit 1. Subsequently, the push-pull manipulator y in the second compartment c2 pushes out the second unit 2 that has already been placed in the second compartment c2, the hoisting machine q lowers the hoisting hook s which is hooked into the hoisting hole sk on the second unit 2 and hoists the second unit 2 to the first compartment c1, and the feeding tray ss in the first compartment c1 receives the second unit 2 and is pulled by the push-pull manipulator y in the first compartment c1 to pull the second unit 2 into the first compartment c1 and place it on the forming base d; then, the positioning pin dx is popped up and inserted into the positioning hole dk so that the second unit 2 is fixed, and replacement between the first unit 1 and the second unit 2 is completed.

Figure 8:
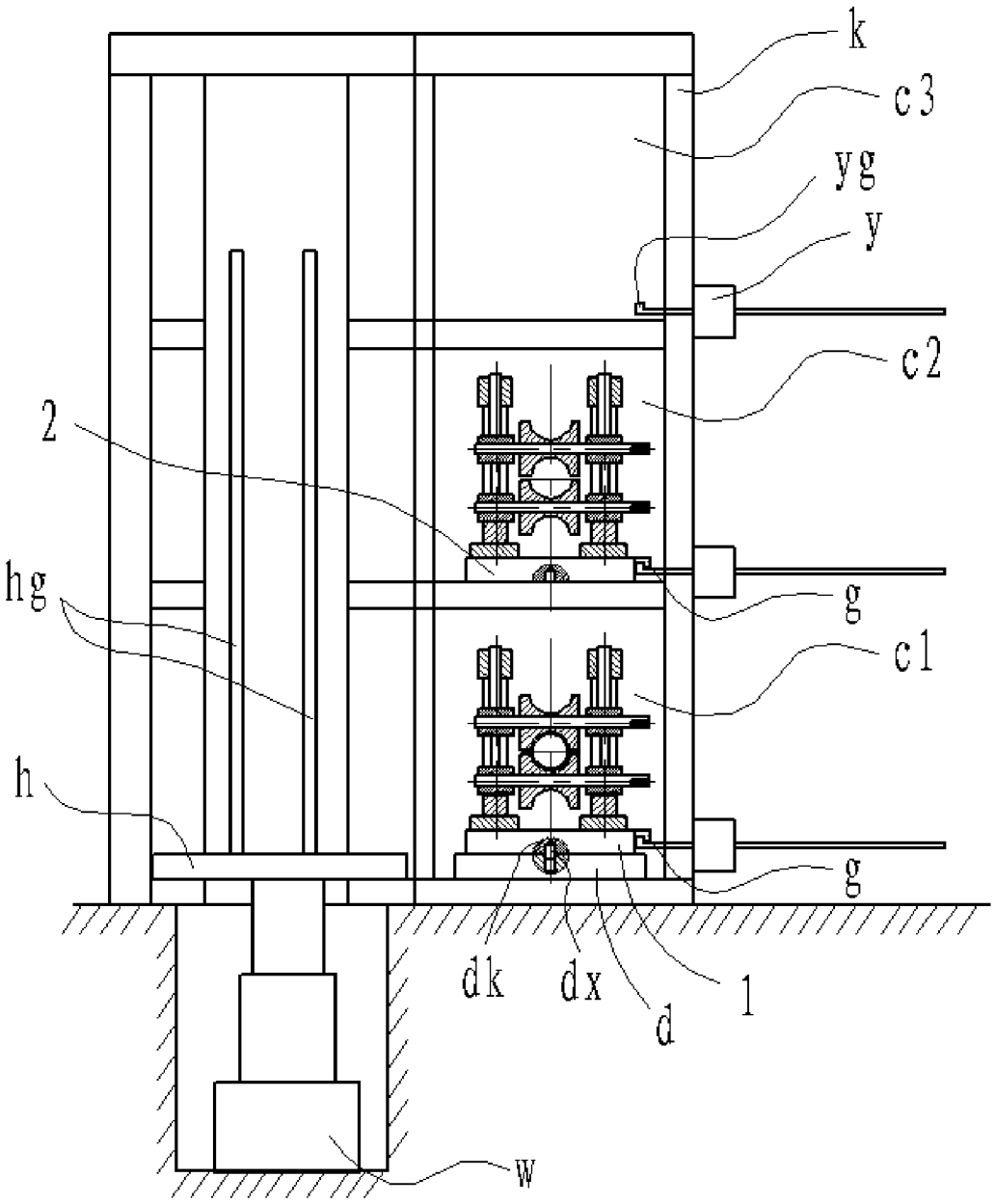
FIG. 8 is a schematic diagram of a basic structure of a second embodiment the present disclosure.

FIG. 8 is a schematic diagram of a basic structure of a second embodiment of the present disclosure.

Figure 9:
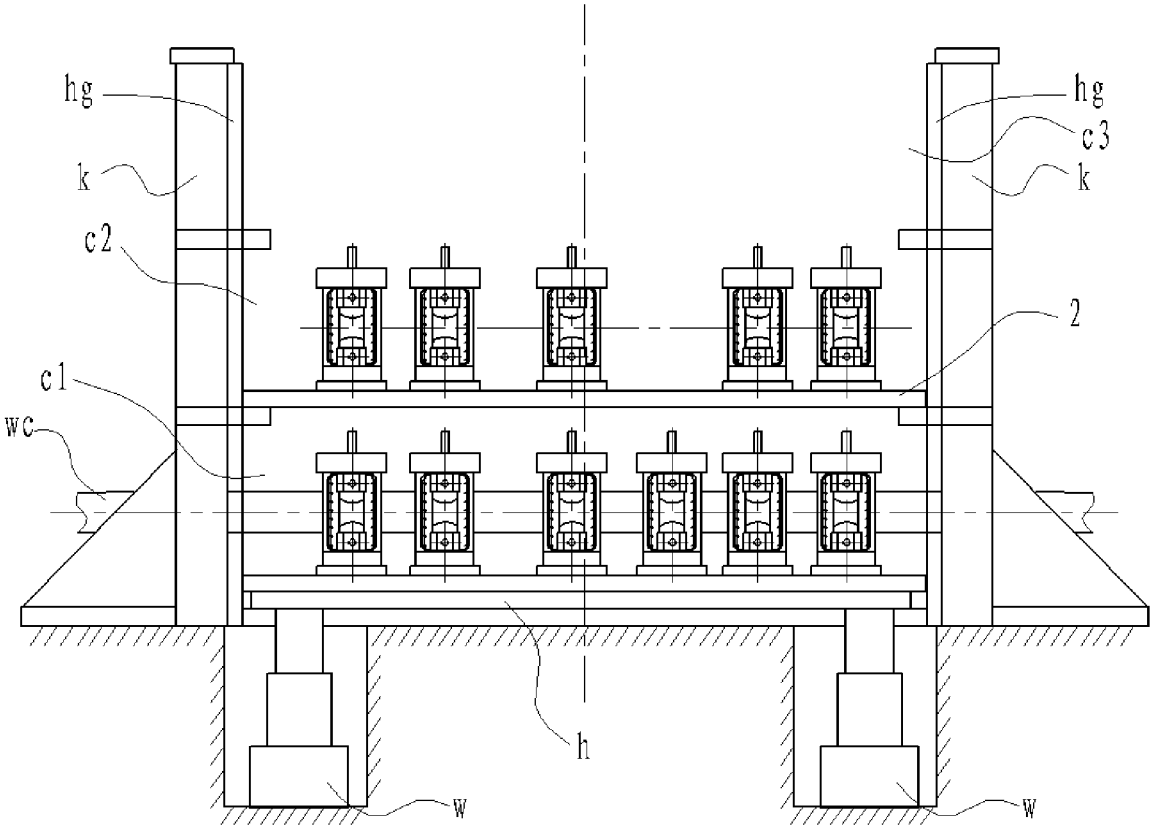
FIG. 9 is a schematic diagram of a front view of the second embodiment of the present disclosure.

FIG. 9 is a schematic diagram of a front view of the second embodiment of the present disclosure.

As shown in FIGS. 8 and 9, according to one aspect of the second embodiment of the present disclosure, the specific technical feature that distinguishes the second embodiment from the first embodiment is that the switching device p is formed as a lifting hydraulic cylinder structure, where two sets of lifting hydraulic cylinders w are disposed on two sides of the three-dimensional frame k, each of the lifting hydraulic cylinders w is installed with a sliding block h at an end, and the sliding block h is coupled with the three-dimensional frame k through a linear sliding rail hg; the sliding block h can support the first unit 1 or the second unit 2, and under the action of the lifting hydraulic cylinder w, the sliding block h can drive the first unit 1 or the second unit 2 to move up and down in the three-dimensional frame k.

Figure 10:
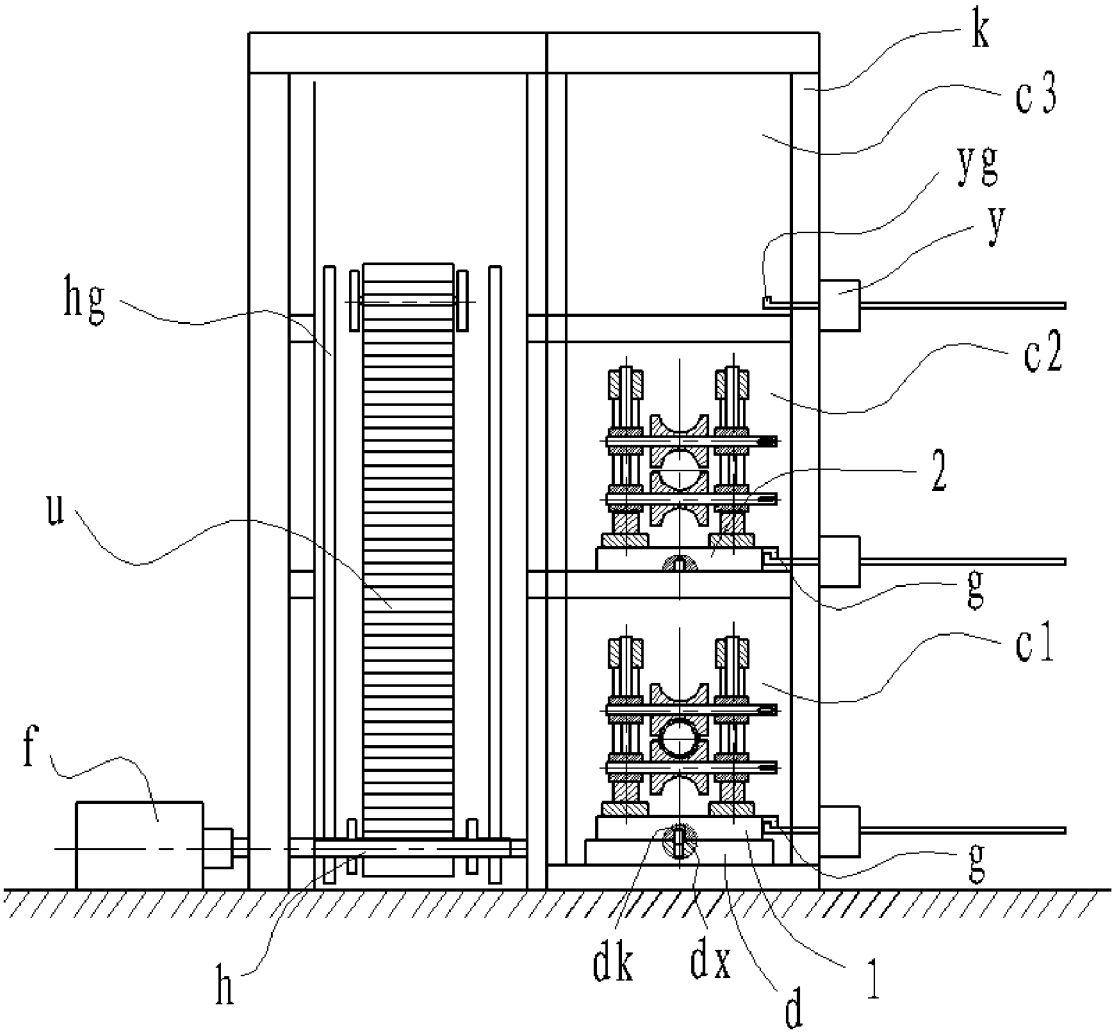
FIG. 10 is a schematic diagram of a basic structure of a third embodiment of the present disclosure.

FIG. 10 is a schematic diagram of a basic structure of a third embodiment of the present disclosure.

Figure 11:
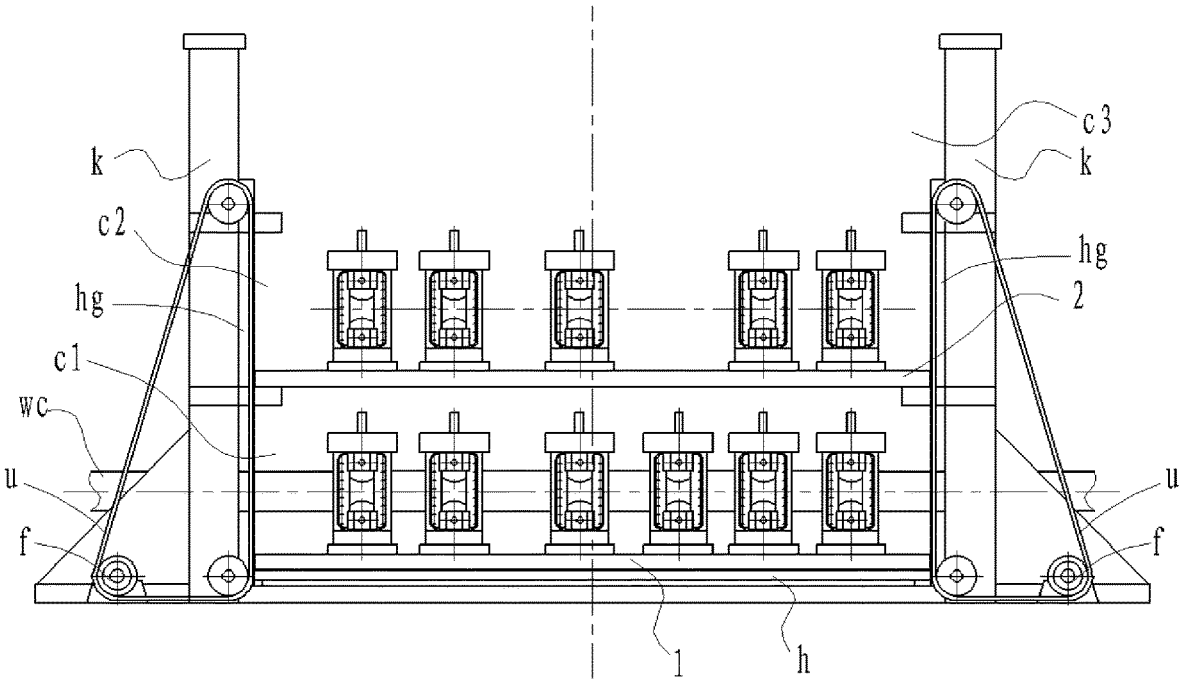
FIG. 11 is a schematic diagram of a front view of the third embodiment of the present disclosure.

FIG. 11 is a schematic diagram of a front view of the third embodiment of the present disclosure.

As shown in FIGS. 10 and 11, according to one aspect of the third embodiment of the present disclosure, the specific technical feature that distinguishes the third embodiment from the first embodiment is that the switching device p is formed as a chain structure, that is, a set of annular closed chain u is disposed on each of two sides of the three-dimensional frame k, a driver f is provided at a bottom of the chain u, and a sliding block h is further provided on the chain u; the sliding block h is coupled with the three-dimensional frame k through a linear sliding rail hg, and can support the first unit 1 or the second unit 2. The driver f can drive the chain u to rotate and drive the sliding block h to support the first unit 1 or the second unit 2 to move up and down in the three-dimensional frame k.

Figure 12:
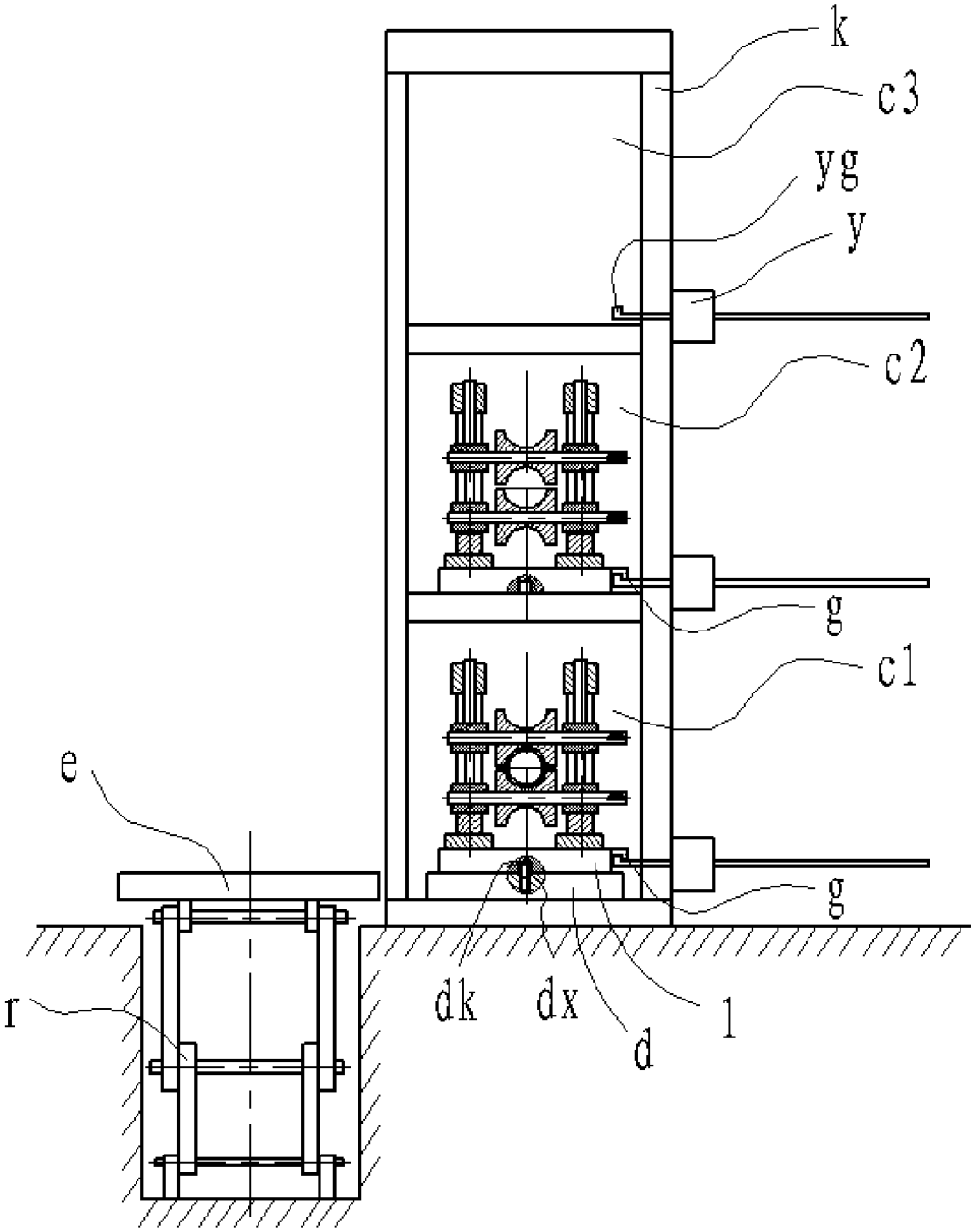
FIG. 12 is a schematic diagram of a basic structure of a fourth embodiment of the present disclosure.

FIG. 12 is a schematic diagram of a basic structure of a fourth embodiment of the present disclosure.

Figure 13:
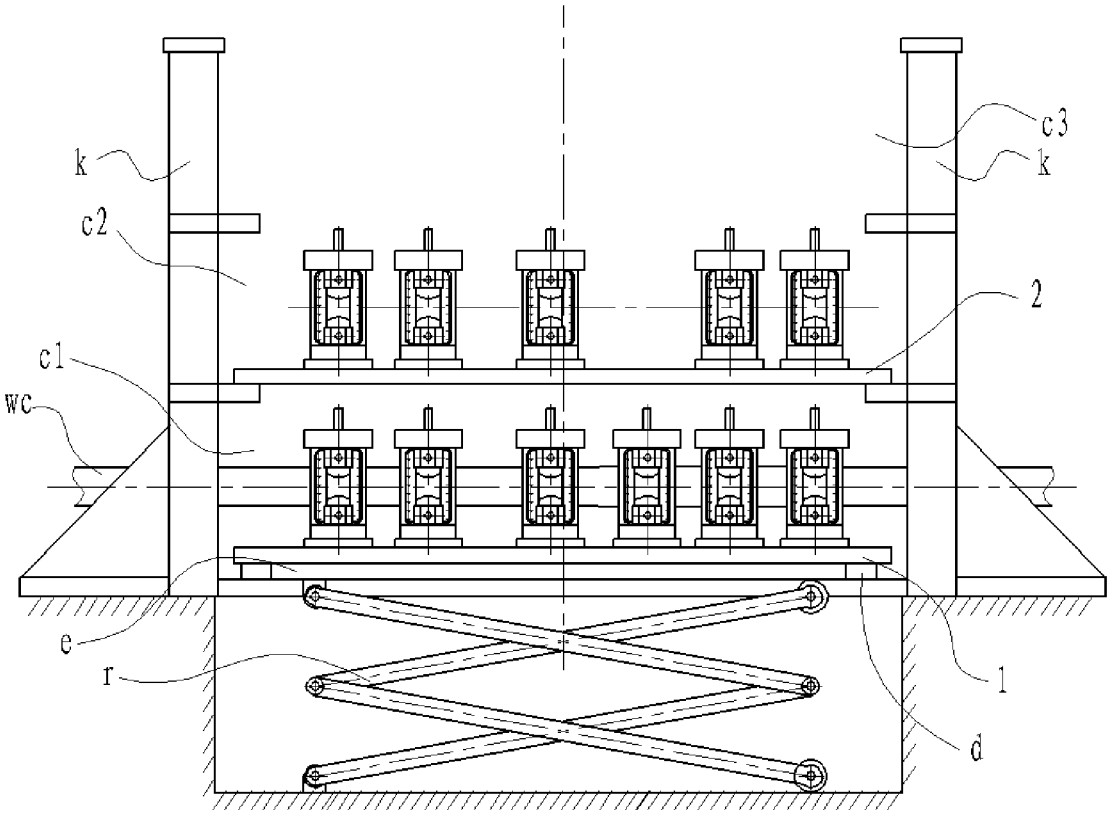
FIG. 13 is a schematic diagram of a front view of the fourth embodiment of the present disclosure.

FIG. 13 is a schematic diagram of a front view of the fourth embodiment of the present disclosure.

As shown in FIGS. 12 and 13, according to one aspect of the fourth embodiment of the present disclosure, the specific technical feature that distinguishes the fourth embodiment from the first embodiment is that the switching device p is formed as a scissor lift structure, where a scissor lift r is disposed on one side of the three-dimensional frame k, the scissor lift r is provided with a platform e, and the platform e can support the first unit 1 or the second unit 2; under the action of the scissor lift r, the platform e can drive the first unit 1 or the second unit 2 to move up and down in the three-dimensional frame k.

It should be understood that the description of the specific embodiments of the present disclosure in the specification is exemplary and should not be interpreted as an improper limitation on the scope of protection of the present disclosure. The scope of protection of the present disclosure is defined by the claims, and covers all the implementations falling within its scope and obvious equivalent variations thereof.

What is claimed is:

1. A three-dimensional replacement machine for a production line, wherein the three-dimensional replacement machine is adapted for replacing forming units in the production line, and the three-dimensional replacement machine comprises:

a first unit;

a second unit, the first unit and the second unit having different processing specifications;

a forming base, on which either one of the first unit and the second unit is capable of being installed to participate in production operations of the production line;

a three-dimensional frame, comprising a first compartment, a second compartment and a third compartment which are arranged one above another in a vertical direction, wherein the first compartment is at the lowest position, and the forming base is disposed in the first compartment; and a switching device, which is coupled with the three-dimensional frame, and is configured to raise and lower the first unit and the second unit to align them with any one of the first compartment, the second compartment and the third compartment, so that the first unit and the second unit can be alternately installed on the forming base to achieve replacement of the specifications in the production line, wherein each of the second compartment and the third compartment is provided with a push-pull manipulator, and the push-pull manipulator is provided with a push-pull hook at an end; each of the first unit and the second unit is further provided with a load-bearing hook for matching with the push-pull hook at an end, and by means of matching of the push-pull hook with the load-bearing hook, the first unit and the second unit can be pulled into or pushed out of the second compartment and the third compartment by the push-pull manipulator.

2. The three-dimensional replacement machine for a production line according to claim 1, wherein the switching device is formed as a hoisting mechanism, which comprises two hoisting machines, each of the two hoisting machines is disposed on each of two sides of an upper end of the three-dimensional frame, and each of the two hoisting machines is provided with a hoisting hook; each of the first unit and the second unit is provided with a hoisting hole for matching with the hoisting hook, and the two hoisting machines can hoist the first unit or the second unit to move up and down in the three-dimensional frame.

3. The three-dimensional replacement machine for a production line according to claim 1, wherein the switching device is formed as a lifting hydraulic cylinder structure, which comprises two lifting hydraulic cylinders, each of the two lifting hydraulic cylinders is disposed on each of two sides of the three-dimensional frame, and an end of each of the two lifting hydraulic cylinders is installed with a sliding block; the sliding block is coupled with the three-dimensional frame through a linear sliding rail, the sliding block can support the first unit or the second unit, and under the action of the lifting hydraulic cylinder, the sliding block can drive the first unit or the second unit to move up and down in the three-dimensional frame.

4. The three-dimensional replacement machine for a production line according to claim 1, wherein the switching device is formed as a chain structure, which comprises two annular closed chains, each of the two annular closed chains is disposed on each of two sides of the three-dimensional frame, a driver is disposed at a bottom of each of the chains, and a sliding block is further disposed on each of the chains; the sliding block is coupled with the three-dimensional frame through a linear sliding rail and can support the first unit or the second unit, and the driver can drive the chain to rotate and drive the sliding block to move the first unit or the second unit up and down in the three-dimensional frame.

5. The three-dimensional replacement machine for a production line according to claim 1, wherein the switching device is formed as a scissor lift structure, and a scissor lift is disposed on one side of the three-dimensional frame, the scissor lift is provided with a platform, and the platform can support the first unit or the second unit; under the action of the scissor lift, the platform can drive the first unit or the second unit to move up and down in the three-dimensional frame.

6. The three-dimensional replacement machine for a production line according to claim 1, wherein the forming base is provided with positioning pins, and both of the first unit and the second unit are provided with positioning holes; positions of the first unit and the second unit relative to the forming base can be accurately positioned through matching of the positioning pins with the positioning holes, thereby ensuring processing accuracy of the production line.

* * * * *